United States Patent [19]

Taberman

[11] 4,225,774

[45] Sep. 30, 1980

[54] METHOD AND INSTALLATION FOR HEATING OF SEATS, ESPECIALLY IN OUTDOOR ARENAS AND THE LIKE

[76] Inventor: Göte Taberman, Skytteholmsvägen 22, Solna, Sweden, S-171 44

[21] Appl. No.: 4,282

[22] Filed: Jan. 17, 1979

[30] Foreign Application Priority Data

Jan. 20, 1978 [SE] Sweden ..... 7800748

[51] Int. Cl.[2] ..... H05B 1/00

[52] U.S. Cl. ..... 219/217; 219/213; 297/180

[58] Field of Search ..... 219/217, 213; 297/180; 128/376, 377, 378; 165/108, 14; 126/204

[56] References Cited

U.S. PATENT DOCUMENTS

| | | | |
|---|---|---|---|
| 2,488,964 | 11/1949 | Conrad | 219/217 |
| 2,521,091 | 9/1950 | Pophal | 297/180 |
| 3,745,305 | 7/1973 | Reed et al. | 219/217 |
| 3,948,246 | 4/1976 | Jenkins | 219/217 X |

FOREIGN PATENT DOCUMENTS

| | | | |
|---|---|---|---|
| 1027859 | 5/1954 | Fed. Rep. of Germany | 219/217 |
| 1654333 | 5/1967 | Fed. Rep. of Germany | 297/180 |
| 2454760 | 11/1974 | Fed. Rep. of Germany | 297/180 |
| 2541543 | 9/1975 | Fed. Rep. of Germany | 297/180 |
| 190665 | 7/1937 | Switzerland | 219/217 |
| 222765 | 11/1942 | Switzerland | 219/217 |
| 271598 | 2/1951 | Switzerland | 297/180 |
| 312825 | 6/1929 | United Kingdom | 219/217 |

OTHER PUBLICATIONS

Kessler, German Printed Publication, 2,541,543, 9/75.
Luedske, German Printed Publication 1,027,859, 5/54.
Maier, German Printed Publication 2,454,760, 11/74.
Schmarbeck, German Printed Publication 1,654,333, 5/67.

*Primary Examiner*—C. L. Albritton
*Attorney, Agent, or Firm*—Holman & Stern

[57] ABSTRACT

The invention relates to a method of heating seats, especially in winter-sports arenas or other non-continuously heated meeting-places, wherein the seats (2) are provided with heating means (4) and divided up into groups which are individually connectible to an energy source by means of a connecting central in response to the demand for seats.

The invention also concerns an installation for carrying out the method, said installation comprising heating elements (4) arranged in each seat and connected to the connection central.

5 Claims, 2 Drawing Figures

Figure 1:
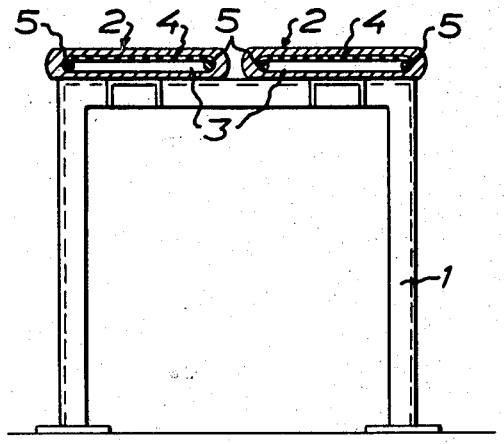

METHOD AND INSTALLATION FOR HEATING OF SEATS, ESPECIALLY IN OUTDOOR ARENAS AND THE LIKE

The invention relates to a method of heating seats, especially winter-sports arenas or other non-continuously heated meeting-places, e.g. churches, and an installation for carrying out the method.

The object of the invention is to provide a method of heating seats in outdoor arenas and the like so that it will be possible to obtain required heating with a minimum supply of energy.

The method of the invention is characterized by the following steps: dividing up the total number of seats into a number of sections or groups which are localized with respect to the expected demand for seats; providing the seats within each such section or group with heating means which can be connected to a source of energy; and carrying out a connecting means in such a way that each section is individually connectible to the energy source in response to the demand for seats.

In conventional freezing units for ice-sports arenas there is produced a considerable amount of excess energy which is entirely wasted.

According to a preferred embodiment the heating problem can be solved as follows.

Air is heated in a heat exchanger by means of excess heat from the freezing plant. The seats to be heated are provided with ducts or cavities arranged in the seat portion proper and in the back rest, if any, and communicating with said heat exchanger and with necessary fan means through piping and/or flexible tubing. The same air will thus have a cooling function in the freezing unit and a heating function in the seats. With regard to the efficiency of the heat exchanger it is endeavoured to obtain the largest possible temperature difference between the freezing medium to be cooled and the air intended to absorb heat. To this end it is preferable to let in outdoor air into the heat exchanger.

Considering the required supply of heat, i.e. the throughflow of air and the intended heat distribution between the benches, outlet openings are suitably arranged in the benches run through by the heated air.

Through the air outlet openings arranged in the benches there is obtained, besides direct heating of the benches, a certain addition of heat to the surroundings from escaping air which has already delivered the major part of its heat to the bench material.

When applied to covered arenas and the like this air heating system gives, without any further arrangements, the required supply of outdoor air and this eliminates the need for separate supply air terminal devices which would otherwise have to be completed with heating coils during the cold season in order to prevent persons positioned near the outlet openings for supply air from being subjected to draught.

The benches are advantageously formed of hollow or channeled profiles of hard wood chip material, preferably provided with a water-resistant surface laminate.

The advantage of using material of this type, which is available under the trade name "WERSALIT", is that it has good resistance to heat as well as to cold, it is moisture-proof and due to the heat insulating capacity provided by the wood it forms a comfortable seat in cold state as well as in heated state.

Electric heating is used for arenas where heating of the seats is required but no excess energy is available for simple use.

Figure 2:
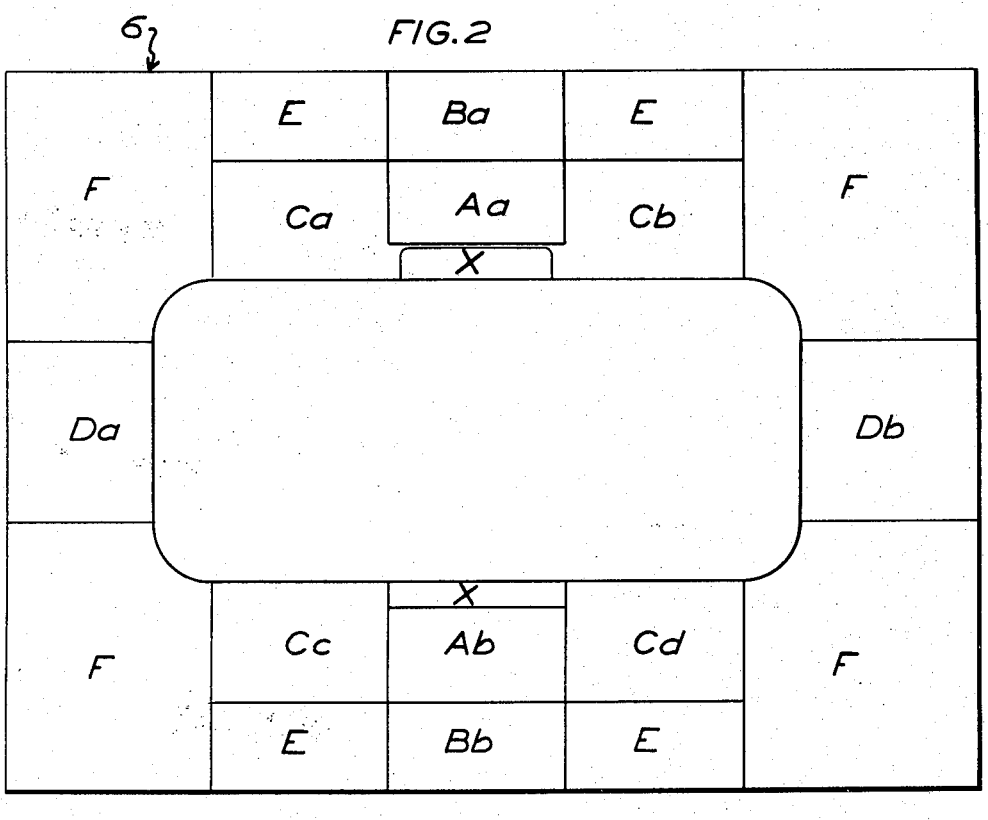

A preferred embodiment of a heating system according to the invention will be more fully described below with reference to the accompanying drawing, in which FIG. 1 shows a bench for use in the installation according to the invention; and FIG. 2 is a schematical view showing on a reduced scale the system for dividing up the arena into individually connectible and disconnectible sections.

The bench shown in FIG. 1 comprises an underframe or stand 1 which, as illustrated, may be designed to rest on a floor or consist of short supports intended for use in combination with already existing seats of a different kind.

In the illustrated embodiment, the seat portion of the bench consists of a pair of hollow profiles 2 of surface-laminated wood chip material, preferably of the type available under the trade name "WERSALIT". Electric surface heating elements 4 are mounted in cavities 3 in the profiles, at the top, i.e. in the upper wall.

In order to facilitate mounting of said elements they are, according to a preferred embodiment, positioned between a pair of current-supply cables 5 which extend along each long side of the cavity 3 and which stiffen and localize the elements in the cavities during as well as after the mounting.

The top side or wall of the profile will be heated by means of heat generated by the elements. To control the heat and prevent overheating the profiles may be provided with thermostats which prevent the profile temperature from exceeding approximately 35° C.

The material described above presents several advantages and among these there may be mentioned good resistance to moisture, heat and cold. As a large percentage of the material is wooden material, it will have a good heat insulating capacity which is advantageous with regard to the distribution of heat in it.

To adjust the energy consumption to actual requirements the benches, which for the sake of simplicity have not been individually illustrated, in the arena 6, schematically shown in FIG. 2, are divided up into sections Aa, Ab, etc.

It is only necessary to connect that or those sections which are expected to be used, and those sections, e.g. Aa, Ab, which are expected to be first filled are first connected and thereupon, as the public flocks together, the other required sections are gradually connected.

The sections designated by X are intended for coachs, trainers, substitutes etc., and these sections may be connected for training purposes and the like, independently of the public sections.

As the heating of the benches takes place relatively rapidly no pre-connection of any note is necessary but the connection may take place gradually as the public arrives, i.e. on the basis of the sale of tickets.

With the described construction of the connection system, the consumption of current may be kept on a level which practically exactly corresponds to the actual need.

The invention should not be considered restricted to that described above and shown in the drawings but may be modified within the scope of the appended claims.

I claim:

1. A method of heating seats in wintersports arenas and other meeting places which are not continuously heated, said method comprising the steps of:

grouping the total number of seats into plural sections which are localized with respect to the expected demand for seats;

simultaneously heating all seats in any section by connecting heating means in said seats to a common source of energy; and independently heating individual sections by selectively connecting each section to said common source of energy as each section becomes occupied.

2. An installation for heating seats in wintersports arenas and other meeting places which are not continuously heated, wherein the seats are grouped in sections and each section of seats can be selectively heated from a common energy source as that section is occupied, said installation comprising:

seat portions, for each of said seats, comprising hollow profiles having cavities defined therein, said profiles being made of a material which is resistant to heat, cold and moisture;

electric surface heating means located in said cavities;

wherein said profiles and said cavities have a height which is relatively small and a width which is relatively large;

wherein each cavity has an upper wall proximate a seating surface;

wherein the electric surface heating means includes heating elements disposed only adjacent said upper wall of said cavity to heat said seating surface;

means connecting together the surface heating means of all seats in individual sections; and means for selectively connecting the heating means of each section individually to said source of energy.

3. The installation according to claim 2 wherein said material is surface-laminated wood chips.

4. The installation according to claim 3 wherein each of the heating elements include a relatively long side, and further comprising a cable connected along said long side to facilitate mounting and localization of the heating elements in said cavities.

5. The installation according to claim 4 wherein said profiles each comprise two U-shaped parts fixedly secured to one another by their shanks.

* * * * *